US007456712B1

(12) United States Patent
Henault et al.

(10) Patent No.: US 7,456,712 B1
(45) Date of Patent: Nov. 25, 2008

(54) CROSS COUPLING TUNING APPARATUS FOR DIELECTRIC RESONATOR CIRCUIT

(75) Inventors: Charles Joseph Henault, Nashua, NH (US); Glen Brian Rochford, Pelham, NH (US)

(73) Assignee: Cobham Defense Electronics Corporation, Bolton, MA (US)

( * ) Notice: Subject to any disclaimer, the term of this patent is extended or adjusted under 35 U.S.C. 154(b) by 20 days.

(21) Appl. No.: 11/743,450

(22) Filed: May 2, 2007

(51) Int. Cl.
*H01P 7/00* (2006.01)

(52) U.S. Cl. ..... 333/235; 333/202

(58) Field of Classification Search ..... 333/202–205, 333/212, 219, 235
See application file for complete search history.

(56) References Cited

U.S. PATENT DOCUMENTS

| | | | |
|---|---|---|---|
| 3,475,642 | A | 10/1969 | Karp et al. |
| 4,028,652 | A | 6/1977 | Wakino et al. |
| 4,138,652 | A | 2/1979 | Nishikawa et al. |
| 4,267,537 | A | 5/1981 | Karmel |
| 4,283,649 | A | 8/1981 | Heinouchi |
| 4,423,397 | A | 12/1983 | Nishikawa et al. |
| 4,459,570 | A | 7/1984 | Delaballe et al. |
| 4,477,785 | A | 10/1984 | Atia |
| 4,578,655 | A | 3/1986 | Etienne et al. |
| 4,620,168 | A | 10/1986 | Delestre et al. |
| 4,661,790 | A | 4/1987 | Gannon et al. |
| 4,757,289 | A | 7/1988 | Kosugi et al. |
| 4,810,984 | A | 3/1989 | Arnold et al. |
| 4,821,006 | A | 4/1989 | Ishikawa et al. |
| 4,835,498 | A | 5/1989 | Rouger et al. |
| 4,881,051 | A | 11/1989 | Tang et al. |
| 5,059,929 | A | 10/1991 | Tanaka |
| 5,109,207 | A | 4/1992 | Aizawa et al. |
| 5,140,285 | A | 8/1992 | Cohen |
| 5,218,330 | A | 6/1993 | Omiya et al. |
| 5,351,319 | A | 9/1994 | Remillard et al. |
| 5,525,945 | A | 6/1996 | Chiappetta et al. |
| 5,614,875 | A | 3/1997 | Jang et al. |
| 5,691,677 | A | 11/1997 | De Maron et al. |

(Continued)

FOREIGN PATENT DOCUMENTS

EP 0 492 304 A1 7/1992

(Continued)

OTHER PUBLICATIONS

Hui et al. "Dielectric Ring-Gap Resonator for Application in MMIC's" IEEE Transactions on Microwave Theory and Techniques vol. 39, No. 12, Nov. 1991.

(Continued)

*Primary Examiner*—Don P Le

(57) ABSTRACT

The invention is an apparatus and technique for tuning the cross coupling of resonators in a dielectric resonator circuit. A cross coupling element such as a coaxial cable having a first end positioned adjacent a first resonator in the circuit and a second end position adjacent a second resonator is supported on the housing of the circuit intermediate its first and second ends. At least one end of the cross coupling element is in contact with a cross coupling tuning element that extends through an external wall of the housing so that it can be manipulated from outside of the housing to move the corresponding end of the cross coupling element relative to the adjacent resonator inside the housing without opening the housing.

20 Claims, 5 Drawing Sheets

U.S. PATENT DOCUMENTS

| | | | | |
|---|---|---|---|---|
| 5,748,058 | A | 5/1998 | Scott | |
| 5,777,534 | A | 7/1998 | Harrison | |
| 5,841,330 | A | 11/1998 | Wenzel et al. | |
| 5,859,574 | A | 1/1999 | Schmitt | |
| 5,949,309 | A | 9/1999 | Correa | |
| 5,990,767 | A | 11/1999 | Ivanov et al. | |
| 6,087,910 | A | 7/2000 | Matsumoto et al. | |
| 6,100,703 | A | 8/2000 | Davidov et al. | |
| 6,111,339 | A | 8/2000 | Ohya et al. | |
| 6,208,227 | B1 | 3/2001 | Remillard et al. | |
| 6,254,708 | B1 | 7/2001 | Cappabianca | |
| 6,262,639 | B1 | 7/2001 | Shu et al. | |
| 6,337,664 | B1 | 1/2002 | Mayes et al. | |
| 6,402,981 | B1 | 6/2002 | Sasaki | |
| 6,707,353 | B1 | 3/2004 | Yamakawa et al. | |
| 6,717,490 | B1 | 4/2004 | Mayer | |
| 6,784,768 | B1 | 8/2004 | Pance et al. | |
| 6,836,198 | B2 | 12/2004 | Engs | |
| 7,057,480 | B2 | 6/2006 | Pance et al. | |
| 2001/0000657 | A1* | 5/2001 | Hershtig | 333/212 |
| 2004/0051602 | A1 | 3/2004 | Pance et al. | |
| 2005/0200435 | A1* | 9/2005 | Pance et al. | 333/202 |
| 2007/0120629 | A1* | 5/2007 | Schnell et al. | 333/219 |

FOREIGN PATENT DOCUMENTS

| | | | |
|---|---|---|---|
| EP | 0 601 370 | A1 | 6/1994 |
| EP | 1 162 684 | A2 | 12/2001 |
| EP | 1 181 740 | B1 | 2/2002 |
| GB | 1 376 938 | | 12/1974 |
| GB | 1 520 473 | | 8/1978 |
| JP | 57-014202 | A | 1/1982 |
| JP | 59-202701 | | 11/1984 |
| JP | 363280503 | A | 11/1988 |
| JP | 01-144701 | | 6/1989 |
| JP | 02-042898 | A | 2/1990 |
| JP | 02-137502 | | 5/1990 |
| JP | 02-168702 | | 6/1990 |
| JP | 05-102714 | | 4/1993 |
| JP | 05-267940 | | 10/1993 |
| JP | 06-061714 | | 3/1994 |
| JP | 07-154114 | | 6/1995 |
| JP | 07-154116 | A | 6/1995 |
| JP | 03-249803 | | 9/2003 |
| WO | WO 00/70706 | | 11/2000 |
| WO | WO 01/43221 | | 6/2001 |
| WO | WO 2004/027917 | A2 | 4/2004 |
| WO | WO 2004/027917 | A3 | 4/2004 |

OTHER PUBLICATIONS

D. Kajfez and P. Guillon "Dielectric Resonators", ISBN 0-89006-201-3, Publisher Artech House, Dedham, MA 1986, pp. 298-317.

E. J. Heller, "Quantum Proximity Resonances", Physical Review Letters, vol. 77, No. 20, Nov. 11, 1966 The American Physical Society, pp. 4122-4125.

K. Pance et al., "Tunneling Proximity Resonances: Interplay Between Symmetry and Dissipation", Physics Department, Northwestern University Aug. 2, 1999, T-143, pp. 16-18, F426.

J. S. Hersch et al., "Observation of Proximity Resonances in a Parallel-Plate Waveguide", Physical Review Letters, vol. 81, No. 15, Oct. 12, 1998, The American Physical Society, pp. 3059-3062.

M. A. Gerdine, "A Frequency-Stablized Microwave Band-Rejection Filter Using Filter Using High Dielectric Constant Resonators", IEEE Transactions on Microwave Theory and Techniques, vol. MTT-17, No. 7, Jul. 1969, pp. 354-359.

S. Verdeyme & P. Guillon, "New Direct Coupling Configuration Between $TE_{01\delta}$ Dielectric Resonator Modes" Electronics Letters, May 25, 1989, vol. 25 No. 11, pp. 693-694.

T. Nishikawa et al., "Dielectric High-Power Bandpass Filter Using Quarter-Cut $TE_{01\delta}$Image Resonator for Cellular Base Stations", IEEE Transactions on Microwave Theory and Techniques, vol. MTT-35, No. 12, Dec. 1987.

A. A. Kishk et al., "Conical Dielectric Resonator Antennas for Wide-Band Applications", IEEE Transactions on Antennas and Propagation, vol. 50, No. 4, Apr. 2002 pp. 469-474.

* cited by examiner

CROSS COUPLING TUNING APPARATUS FOR DIELECTRIC RESONATOR CIRCUIT

FIELD OF THE INVENTION

The invention pertains to dielectric resonator circuits and, more particularly, to cross coupled dielectric resonator circuits used in circuits such as microwave filters, oscillators, triplexers, antennas, etc.

BACKGROUND OF THE INVENTION

Dielectric resonators are used in many circuits, particularly microwave circuits, for concentrating electric fields. They can be used to form filters, oscillators, triplexers, and other circuits.

FIG. 1 is a perspective view of a typical dielectric resonator of the prior art. As can be seen, the resonator 10 is formed as a cylinder 12 of dielectric material with a circular, longitudinal through hole 14. While dielectric resonators have many uses, their primary use is in connection with microwaves and, particularly, in microwave communication systems and networks.

As is well known in the art, dielectric resonators and resonator filters have multiple modes of electrical fields and magnetic fields concentrated at different center frequencies. A mode is a field configuration corresponding to a resonant frequency of the system as determined by Maxwell's equations. In a dielectric resonator, the fundamental resonant mode frequency, i.e., the lowest frequency, is the transverse electric field mode, TE01δ (hereinafter the TE mode). Typically, it is the fundamental TE mode that is the desired mode of the circuit or system into which the resonator is incorporated. The second mode is the hybrid mode, $H_{11}$ (or $H_{11}$, hereafter). The $H_{11}$ mode is excited from the dielectric resonator, but a considerable amount of electric field lays outside the resonator and, therefore, is strongly affected by the cavity.

FIG. 2 is a perspective view of a dielectric resonator filter 20 of the prior art employing a plurality of dielectric resonators 10. The top wall (cover) is removed in the Figure to reveal the components of the filter. However, typically, of course, the housing 24 is completely enclosed. The resonators 10 are arranged in the cavity 22 of a conductive housing 24. Conductive tuning plates 42 may be positioned above the resonators 10 to permit adjustment of the center frequency of the resonators. The conductive housing 24 commonly is rectangular, comprising six planar external walls.

Microwave energy is introduced into the cavity via an input coupler 28. The energy may then be coupled to a first resonator (such as resonator 10*a*) using a coupling loop. Conductive separating walls 32 separate the resonators from each other and block (partially or wholly) coupling between the resonators 10. Specifically, conductive material within the electric field of a resonator essentially absorbs the field coincident with the material and turns it into current in the conductor so that the field does not pass through to the other side of the wall. In other words, conductive materials within the electric fields cause losses in the circuit. Hence, conductive walls without irises generally prevent all coupling between the resonators separated by the walls, while walls with irises 30 permit a controlled amount of coupling between adjacent resonators.

Conductive adjusting screws 33 coupled to the floor 26 of the housing 24 may be placed in the irises 30 to further affect the coupling of the fields between adjacent resonators and provide adjustability of the coupling between the resonators. When positioned within an iris, a conductive adjusting screw partially blocks the coupling between adjacent resonators permitted by the iris. Inserting more of the conductive screw into the iris reduces coupling between the resonators while withdrawing the conductive screw from the iris increases coupling between the resonators.

Tuning plates 42 may be provided adjacent each resonator mounted on adjusting screws 44 passing through the top cover (removed and not shown in FIG. 2 to permit viewing of the components of the circuit 20) of the enclosure 24.

In a typical dielectric resonator circuit, such as a filter, the resonators are allowed to couple to each other in one particular order. For instance, in the microwave filter illustrated in FIG. 2, the energy from the input coupler 28 couples to the first resonator 10*a*. Resonator 10*a* couples to resonator 10*b* through the iris 30*a* in wall 32*b*, resonator 10*b* also couples to resonator 10*c* through the iris 30*b* in wall 32*c*, resonator 10*c* couples to resonator 10*d* through the iris 30*c* in internal wall 32*d*, etc. Longitudinal separating wall 32*a* contains no iris and therefore prevents cross coupling between any other pairs of resonators. The internal walls 32*b*, 32*c*, 32*d* also prevent other cross coupling, such as resonators 10*a* and 10*c* and resonators 10*b* and 10*d*.

A coupling loop connected to an output coupler 38 is positioned adjacent the last resonator 10*d* to couple the microwave energy out of the filter 20.

In some dielectric resonator filter circuits, it may be desirable to provide for cross coupling between otherwise non-adjacent resonators. This may be desirable in order to adjust the bandwidth (or rejection) of the filter. Specifically, the sizes of the resonators 10, their relative spacing, the number of resonators, the size of the cavity 22, the size of the irises 30, and the size and position of the tuning plates 42 and/or tuning screws 33 all have some effect on (and need to be controlled to set) the desired center frequency of the filter, the bandwidth of the filter, and the rejection in the stop band of the filter. The bandwidth of the filter is controlled primarily by the amount of coupling of the magnetic fields between the various dielectric resonators, which is largely a function of the distances between the coupling resonators and the size of the irises (or other opening) between the resonators. Generally, the more coupling between the individual resonators, the wider the bandwidth of the filter. On the other hand, the center frequency of the filter is controlled in large part by the size of the resonator and the size and the spacing of the tuning plates 42 from the corresponding resonators 10.

In order to permit cross coupling of the electromagnetic fields between resonators that would not otherwise exist due to distance and/or the separating walls 32, a cross-coupler 34 comprising a conductive element, such as a coaxial cable, can be provided that extends through a hole or slot 25 in one or more of the separating walls 32 between two dielectric resonators, e.g., resonators 10*a* and 10*c*. If desired in order to obtain more optimum filter transfer functions, the cross coupler can be prevented from making conductive contact with the housing by a non-conductive bushing 34*a*. The non-conductive bushing 34*a* would electrically isolate the probe 34*b* from the housing 24 so that electric fields coincident to the probe 34*b* are not absorbed by the walls of the housing, but rather are passed from one end of the cross coupler 34 to the other for coupling resonators adjacent the ends of the cross coupler 34.

A detailed discussion of cross-coupled dielectric resonator circuits is found in U.S. Pat. No. 5,748,058 to Scott entitled CROSS COUPLED BANDPASS FILTER.

As previously noted, it may be desirable to alter the amount of cross coupling provided through the cross coupling element 34 in order to tune the bandwidth or rejection of the filter. In the past, this has been done manually by opening the housing and physically bending the cross coupling elements to move it closer to or farther from the corresponding resonator(s). This is a laborious and time-consuming process because it typically requires the removal of one of the walls to permit access to the cavity. The housings typically are constructed of one removable wall attached by a large number of screws, not uncommonly several dozen. Thus, simply opening the housing to gain access to the cavity might require unscrewing 20, 30, 40, or even more screws, which then, after tuning, of course, need to be tightened again in order to enclose the housing. Since tuning is an imprecise process, commonly, the filters will then be tested to see if the desired bandwidth or rejection has been achieved. If not, the screws would need to be removed again, the wall removed, the cross coupling element re-adjusted, the wall replaced, the screws reattached, and the filter tested again.

In addition, typical necessary adjustments in the position of the end of the cross coupling element might be on the order of hundredths or even thousandths of an inch. Accordingly, performing such adjustments by bending the cross coupling element by hand or even with tools, can be extremely difficult.

SUMMARY OF THE INVENTION

In accordance with a first aspect of the invention, a dielectric resonator circuit is provided comprising a plurality of dielectric resonators, each comprising a body formed of a dielectric material, a housing enclosing the resonators, a cross coupling element for permitting electromagnetic coupling between a first one and a second one of the resonators, the cross coupling element having a first end positioned adjacent the first one of the resonators and a second end positioned adjacent the second one of the resonators, a tuning element for moving the first end of the cross coupling element relative to the first one of the resonators, the tuning element comprising a resilient strip suspended from the housing such that a portion of the strip is unsupported, wherein the first end of the cross coupling element is in contact with the unsupported portion of the strip such that flexing of the resilient strip will cause displacement of the first end of the cross coupling element relative to the first resonator, and a post having a longitudinal axis extending through a hole in the housing such that a proximal end of the post is outside of the housing and a distal end of the post is in contact with the unsupported portion of the strip inside the housing, whereby movement of the post in at least one direction along the longitudinal axis will exert a force on the resilient strip causing it to flex, whereby the first end of the cross coupling element is moved.

In accordance with another aspect of the invention, a dielectric resonator circuit is provided comprising a plurality of dielectric resonators, each comprising a body formed of a dielectric material, a housing enclosing the resonators, a flexible, conductive cross coupling element for permitting electromagnetic coupling between a first one and a second one of the resonators, the cross coupling element having a first end positioned adjacent the first one of the resonators, a second end positioned adjacent the second one of the resonators and a middle portion, wherein the first and second ends of the cross coupling element are unsupported and the middle portion is supported on the housing, a post having a proximal end and a distal end defining a longitudinal axis therebetween, the post extending through a hole in the housing such that the proximal end of the post is outside of the housing and the distal end of the post is inside the housing adjacent the first end of the cross coupling element, whereby movement of the post in at least one direction along the longitudinal axis will exert a force on the first end of the cross coupling element causing it to move relative to the first one of the resonators.

DETAILED DESCRIPTION OF THE INVENTION

Figure 3A:
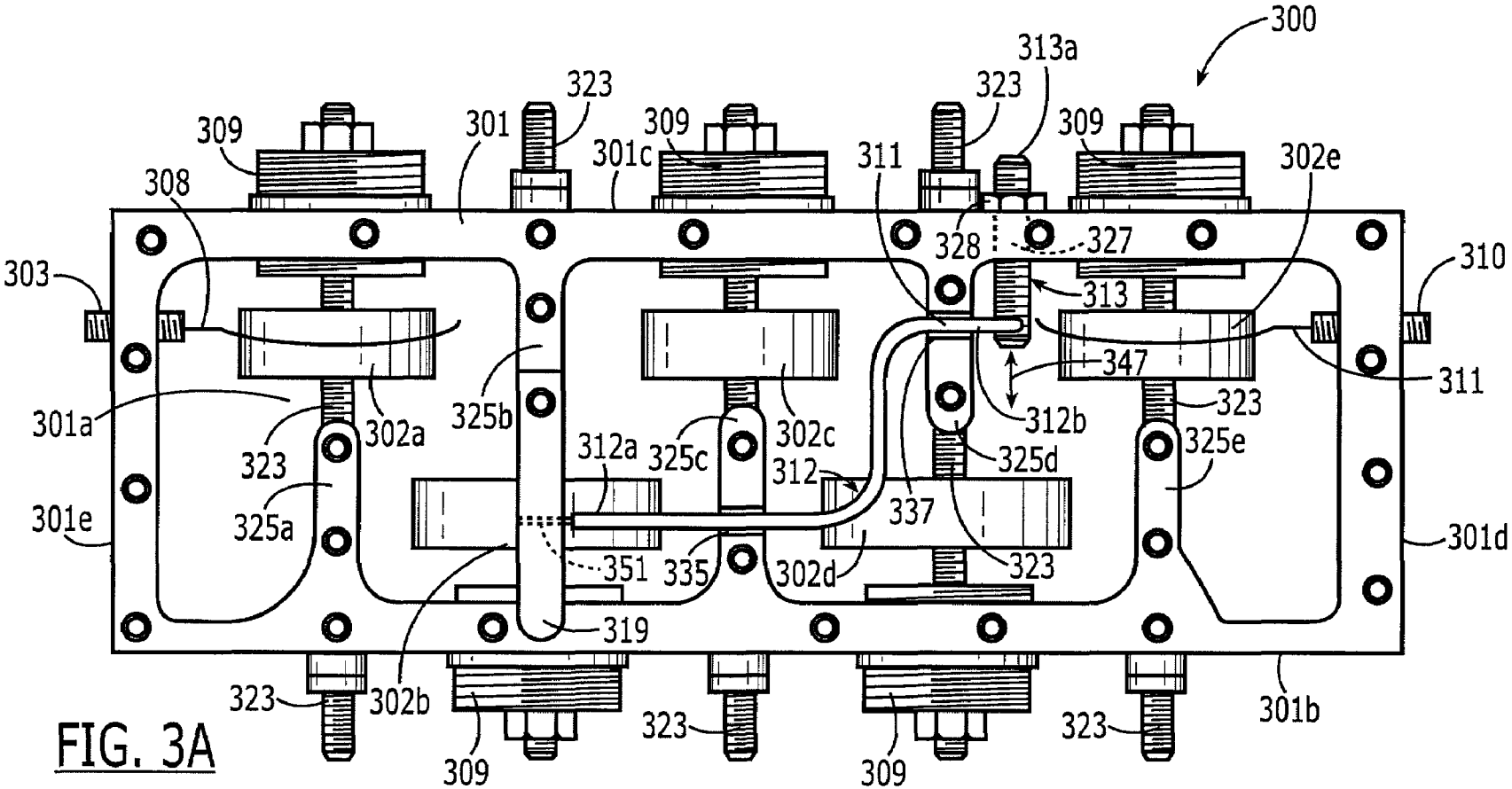
FIG. 3A is a top view of an exemplary cross coupled dielectric resonator filter in accordance with the principles of the present invention with the top wall removed.
Figure 3B:
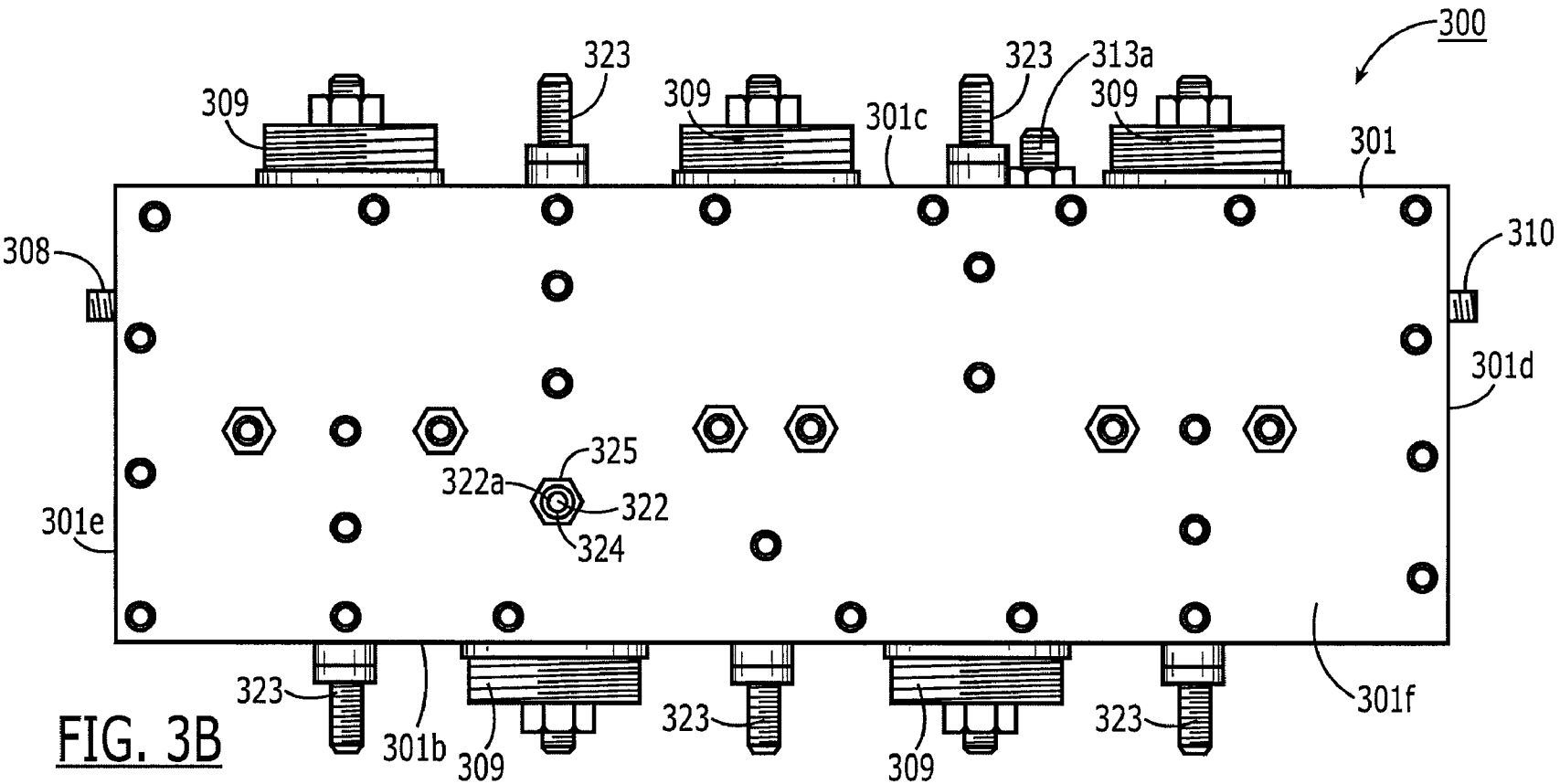
FIG. 3B is a perspective view of the exemplary cross coupled dielectric resonator filter of FIG. 3A with the top wall in place.

FIG. 3A is a top view with the top wall removed of an embodiment of a cross coupled dielectric resonator filter 300 in accordance with the principles of the present invention. FIG. 3B is a top view of the same filter 300 with the top wall in place. The filter 300 comprises a housing 301 having a bottom wall 301*a*, four side walls 301*b*, 301*c*, 301*d* and 301*e*, and a top wall (cover) 301*f* to form a complete enclosure. Dielectric resonators 302*a*, 302*b*, 302*c*, 302*d*, 302*e* are positioned within the housing 301 for processing a field received within the cavity of the filter 300. Although a filter is depicted and described, the present invention is applicable to other types of dielectric resonator circuits, including by way of example oscillators, triplexers, antennas, etc.

Figure 1:
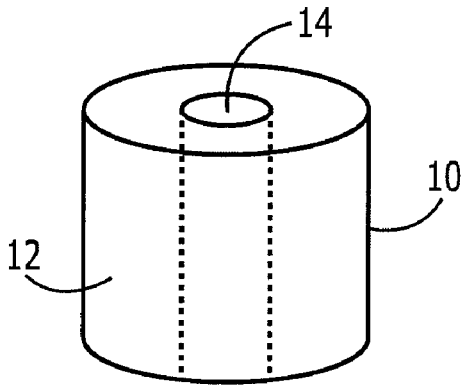
FIG. 1 (PRIOR ART)
FIG. 1 is a perspective view of a cylindrical dielectric resonator of the prior art.
Figure 2:
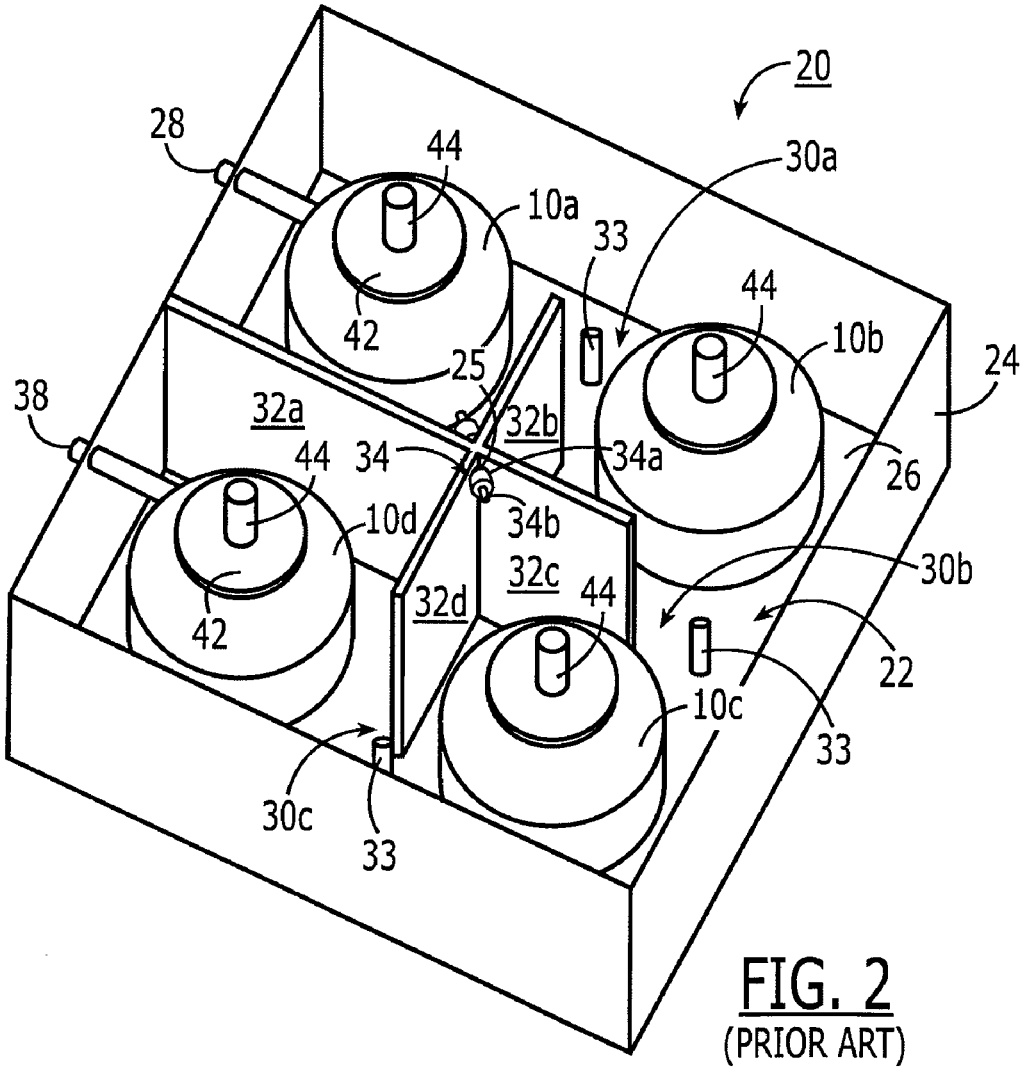
FIG. 2 (PRIOR ART)
FIG. 2 is a perspective view of an exemplary cross coupled dielectric resonator filter of the prior art with the top wall removed.

A field may be coupled into the filter 300 through any reasonable means known in the prior art or discovered in the future, including by a microstrip on a surface of the housing or by a coupling loop as described in connection with FIG. 2 in the background section of this specification. In one embodiment, a field supplied from a conductive probe 303 is coupled to an input coupling loop 308 positioned near the first resonator 302*a* and passed at an output coupling loop 311 and a coaxial cable 310 positioned near the last resonator 302*e*.

The plurality of resonators 302 are arranged within the housing in any configuration suitable to achieve the performance goals of the filter. In the illustrated embodiment, the resonators 302 are positioned in a row with their longitudinal axes are parallel to each other (but not collinear) and generally reside in one of two planes perpendicular to their longitudinal axes. For example, resonators 302*a*, 302*c*, and 302*e*, reside in one plane and resonators 302*b* and 302*d*, reside in another plane. The resonators 302 are mounted on threaded posts 323 disposed in matingly threaded holes in the housing so that the resonators may be moved along their longitudinal axes for tuning purposes (i.e., to adjust the bandwidth of the filter). The circuit includes internal walls 325*a*, 325*b*, 325*c*, 325*d*, and 325*e* to permit significant coupling between adjacent resonator pairs, e.g., resonator pair 302*a* and 302*b*, resonator pair 302*b* and 302*c*, resonator pair 302*c* and 302*d*, and resonator pair 302*d* and 302*e*, while substantially blocking the fields of non-adjacent resonators from coupling. For instance, there is a large volume of space uninterrupted by a conductive wall between each pair of adjacent resonators so that there is significant coupling between them. On the other hand, the internal walls 325*a*-325*e* substantially interrupt the path for coupling of fields between non-adjacent resonators, such as resonators 302*a* and 302*c*.

The filter 300 further includes circular conductive tuning plates 309 adjustably mounted on the housing 301 so that they can be moved longitudinally relative to the resonators 302. These tuning plates are used to adjust the center frequency of the resonators, and thus the filter. These plates may be threaded cylinders that pass through holes in the housing 301 to provide adjustability after assembly.

In this example, a cross coupling element is provided to permit cross coupling between resonators 302*b* and 302*e* in order to obtain a particular desired bandwidth (and/or other operating parameter) of the circuit. Merely as an example, the cross coupling element is a coaxial cable 312 having a first end 312*a* adjacent resonator 302*b* and a second end 312*b* adjacent resonator 302*e*. The cross coupling element can be supported in the circuit by being press fitted into two slots 335, 337 machined into two of the internal walls 325.

The first end 312*a* of the cross coupling element 312 adjacent resonator 302*b* is attached to a resilient (i.e., providing spring action) strip of material 319. At least some portion of the resilient strip 319 is unsupported (or suspended). In the illustrated embodiment of FIG. 3A, the strip 319 is a bridge that is supported at its first and second ends by internal wall 325*b* and external wall 301*b*, respectively, but is unsupported in its middle. Alternately, the strip could be cantilevered from just one of its ends and the other end may be unsupported.

In one embodiment of the invention, the strip 319 is made of Ultem™, a polyetherimide polymer material available from General Electric Company. This material is suitable because Ultem™ has a coefficient of thermal expansion substantially similar to that of aluminum, which is a common material of the housing 301. However, any material that is resilient and is sufficiently strong so as not to fail (break or become unresilient) under normal operating conditions would be acceptable.

The cross coupling element 312 is attached to the flexible strip 319 at an unsupported portion of the strip 319. In the embodiment of FIGS. 3A and 3B, the end 312*a* of the cross coupling element 312 is inserted into a hole 351 drilled into the middle of the strip 319. In the illustrated embodiment, the outer conductor and the insulating layer have been removed from the first end 312*a* of the cross coupling element 312 so that the hole 351 in the flexible strip 319 may have a very small diameter so as not to weaken the flexible strip 319. However, this is merely an implementation detail. If the material of the flexible strip is sufficiently strong or the strip itself is sufficiently thick or the cross coupler is sufficiently thin, no such accommodations may be needed.

Alternately, the end of the cross coupling element could be adhered to the strip, attached to it by a clip or other attaching mechanism, integrally formed with it, etc. In even further alternative embodiments, the cross coupling element need not be fixed to the strip 319, but could merely be in unfixed contact with it, as long as flexing of the strip 319 causes movement of the end 312*a* of the cross coupling element 312, as discussed in more detail below.

A post, which may be in the form of a threaded screw 322, is disposed in a threaded hole 324 in the top wall (cover) 301*f* of the housing 301 in a position such that the distal tip of the screw 322 is directly above the suspended portion of the resilient strip 319, and preferably directly above the first end 312*a* of the cross coupling element 312. The proximal end of the screw 322 is exposed on the outside of the housing 301 and preferably has a head 322*a* including an engagement recess for a screwdriver or other turning tool. Hence, rotation of the screw 322 to cause it to advance into the hole 324 causes the distal tip of the screw to push against the strip 319, causing it to deflect downwardly, which, in turn, moves the first end 312*a* of the cross coupling element 312 closer to the resonator 302*b*. Rotating the screw to back it out of the hole releases the pressure on the strip 319, thereby permitting the resilient strip 319 to return to its normal unbiased position, thereby moving the end 312*a* of the cross coupling element away from the resonator 302*b*.

This mechanism allows for extremely small and precise adjustment to the position of the end 312*a* of the cross coupler 312 relative to the resonator 302*b* by rotating the screw from outside of the housing without the need to open the housing. The smaller the pitch of the threads of the screw, the smaller the movement of the cross coupler for a given amount of rotation of the screw and, therefore, the more precise an adjustment that can be achieved. For instance, a #4-40 set screw would provide an angular-rotation-to-translation-of-the-screw of about 0.0250 inches per turn of the screw (i.e., 360° rotation). In other words, one complete 360° turn of the screw would result in the end of the cross coupling element moving 0.025 inches (assuming the screw tip is in contact with the flexible strip to begin with).

The tip of the screw 322 does not need to be attached to the strip, but merely in contact with it. Of course, if the screw is not attached to the strip, it can only flex the strip downwardly from the neutral unbiased position since the screw will simply lose contact with the strip if it is unscrewed from the housing from the unbiased position of the strip 319. Thus, in such embodiments, it would be advisable to place the strip so that the end 312*a* of the cross coupling element 312 is at the maximum potentially useful distance from resonator 302*b* when the strip 319 is unbiased. However, to provide even greater adjustment options, the distal tip of the screw may be rotatably attached to the strip, such as by a rotatable rivet type connection. In this manner, the screw 322 can be screwed in or out of the housing in order to flex the strip 319 downwardly as well as upwardly from the unbiased position.

A nut 325 may be positioned on the screw 322 on the outside of the housing 301 for locking the screw 322 in a selected position by tightening the nut 325 on the screw 322 against the housing 301 when the cross coupler is in the desired position.

In an alternative embodiment, the flexible strip 319 may be omitted and the tip of the screw may directly contact the first end 312*a* of the cross coupling element 312. In this embodiment, the screw 322 should be non-conductive because it contacts the cross coupling element directly. It may be formed of Ultem™. Also, the cross coupling element 312 itself should be resilient in this embodiment so that it will flex back upwardly upon unscrewing of the screw. Sufficiently resilient coaxial cables are widely available. Alternately, the end of the cross coupling element could be attached to the tip of the screw, such as by a rotatable rivet type connection. In this case, the cross coupling element would not necessarily have to be resilient, but merely flexible (i.e., it can bend without breaking, but does not necessarily have to bend back to an unbiased position upon release of force).

In one embodiment of the invention, only one end of the cross coupling element is adjustable. However, in other embodiments, the second end 312*b* of the cross coupling element 312 also may be adjustable in accordance with the principles of the present invention.

FIGS. 3A and 3B illustrate an embodiment in which both ends of the cross coupling element are adjustable. FIGS. 3A and 3B illustrate a second embodiment of an adjustment mechanism at the second end of the cross coupling element 312. However, it should be understood that the same type of adjustment mechanism used at end 312*a* of the cross coupling element 312 as described hereinabove can be used for both ends of the cross coupling element. In accordance with this embodiment, the second end 312*b* of the cross coupling element 312 is inserted into a hole drilled radially into the distal end of another threaded screw 313 that passes through another threaded hole 327 in the housing. The screw should be non-conductive because it contacts the cross coupling element directly. The screw 313 may be formed of Ultem™, for instance. In this case, the screw can be gripped from its proximal end 313*a* and rotated very slightly, e.g., on the order to less than about 5-10° rotation to cause the distal end 312*b* of the cross coupler to move toward or away from the resonator 302*e*. This form of adjustment is more coarse than the adjustment mechanism provided at the first end 312*a* of the cross coupling element, as described above. Particularly, with this type of adjustment mechanism, a small rotation of the screw will cause significant movement in the position of the end 312*b* of the cross coupler 312. Furthermore, rotation of substantially more than about 5-100 might permanently deform or even break the cross coupler. Preferably, a locking nut 328 or some other means is included to fix the screw 313 in position once tuned to insure it remains stationary.

In another embodiment, screw 313 and hole 327 are not threaded, but are instead frictionally engaged. In this embodiment, the screw 313 can be both pushed in or pulled out of the hole to move the distal end 312*b* of the cross coupling element 312 in the direction of arrows 347 in FIG. 3A, which also would affect the amount of cross coupling. Note that the screw 313 in this embodiment also still can be rotated in the hole 327 to affect coupling.

In accordance with the invention, the positions of the ends of a cross coupler can be adjusted without the need to open the housing, saving substantial effort and time during cross coupling tuning. Furthermore, it can be adjusted in minute increments with great precision.

The invention also makes the overall circuit more robust and shock resistant because it provides additional, resilient support for ends of the cross coupling element.

Figure 4A:
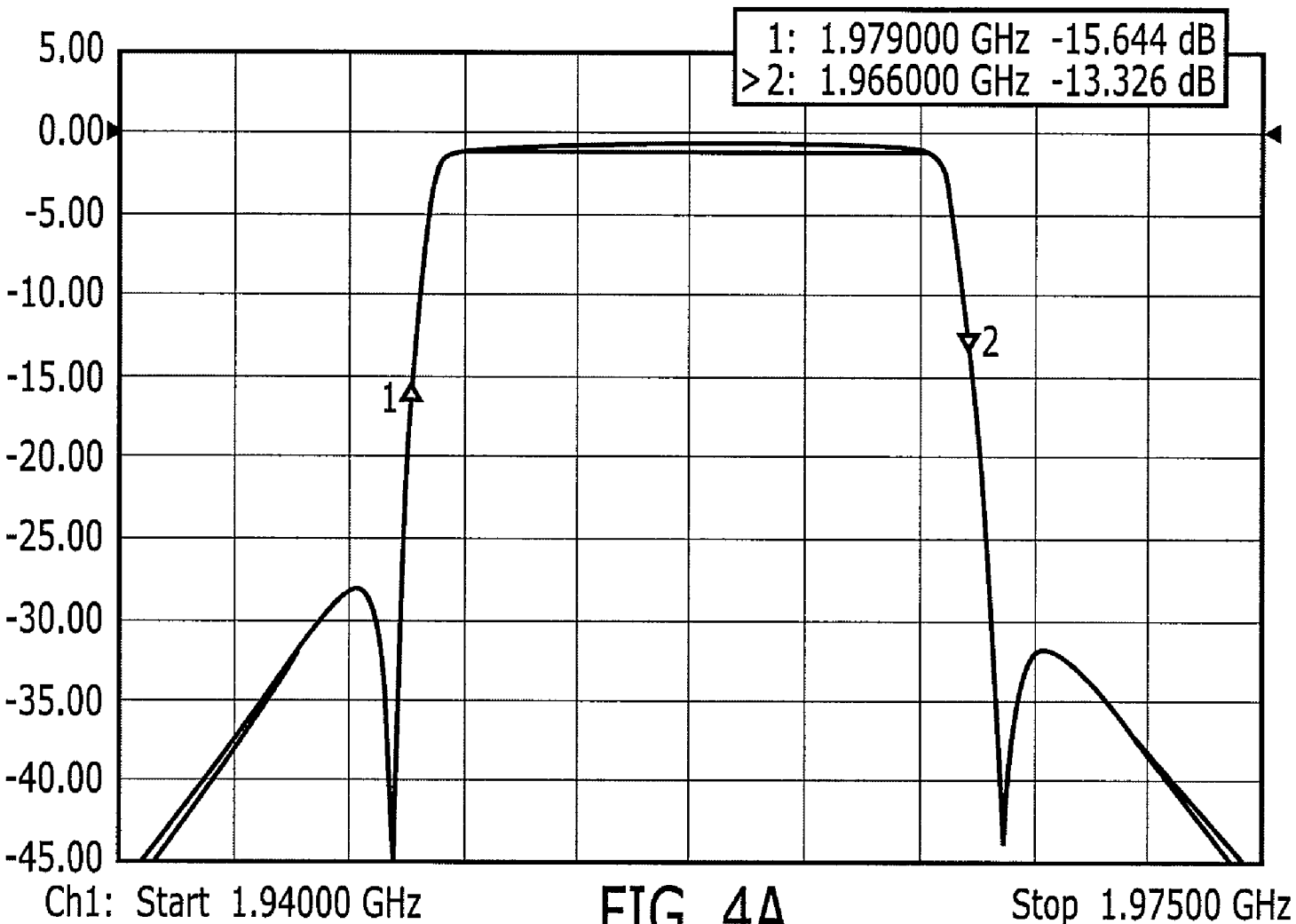
FIG. 4A is a graph showing the frequency response of the exemplary pass band filter of FIGS. 3A and 3B before adjustment of the cross coupler.
Figure 4B:
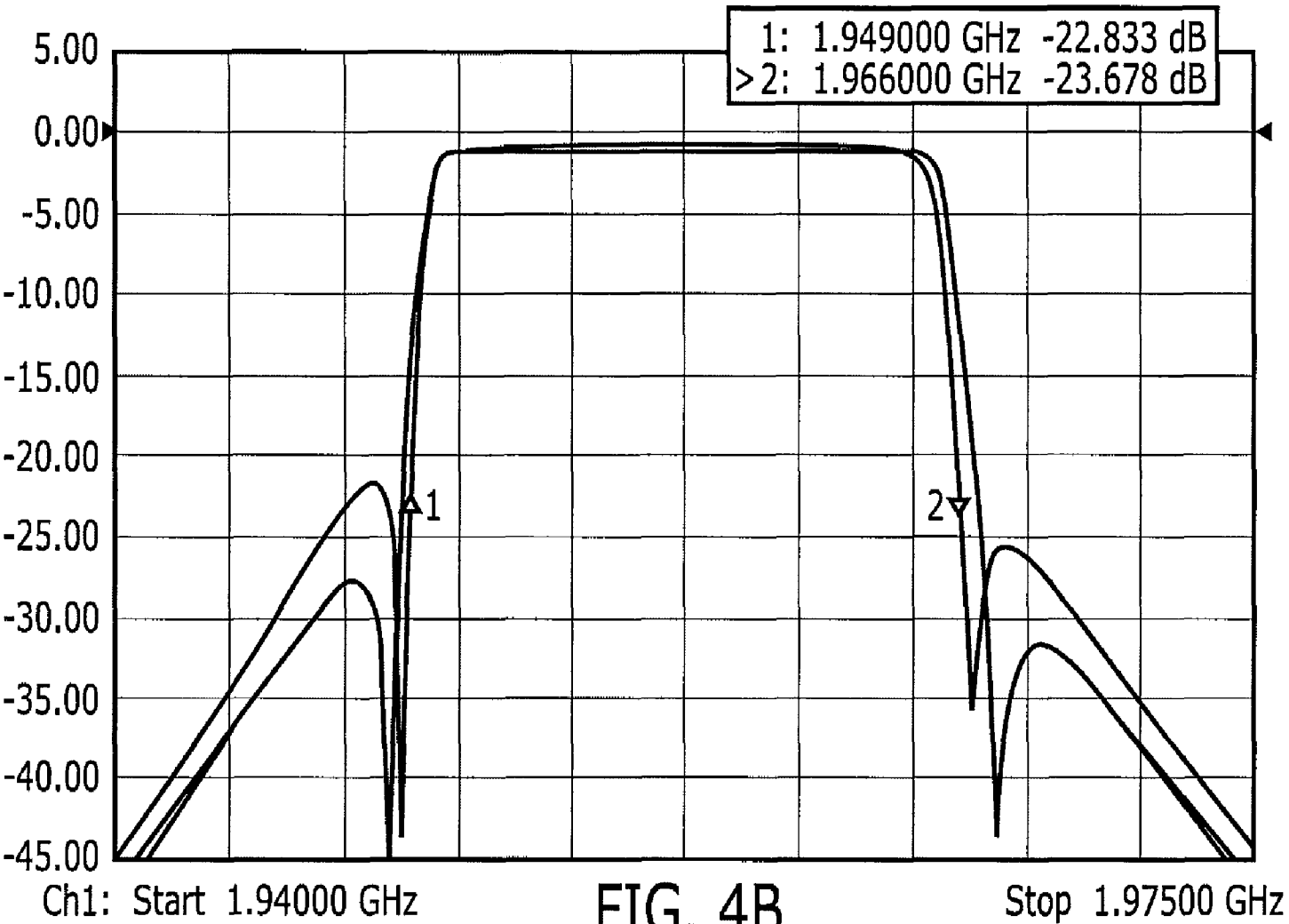
FIG. 4B is a graph showing the frequency response of the exemplary pass band filter of FIGS. 3A and 3B after adjustment of the cross coupler.

FIGS. 4A and 4B are graphs showing the frequency response of the exemplary pass band filter of FIGS. 3A and 3B before and after adjustment of the cross coupler. In particular, the desired pass band of this filter is 1950.625 GHz-1964,375 GHz, with rejection requirements at 1.949 GHz and 1.966 GHz. FIG. 4A shows that, prior to adjustment, i.e., with the strip 319 in the unbiased position, signal strength is −15.644 dB at the desired lower rejection frequency of 1.949 GHz and signal strength is −13.326 dB at the desired upper rejection frequency of 1.966 GHz.

FIG. 4B shows the frequency response of the filter after the adjusting screw 319 has been turned two full turns (720° of rotation) resulting in a 0.050 translation of the first end of the cross coupler. It can be seen that the filter rejection has been substantially improved to −22.833 dB at the lower rejection frequency of 1.949 GHz and −23.678 dB at the upper rejection frequency of 1966 GHz.

Having thus described a few particular embodiments of the invention, various alterations, modifications, and improvements will readily occur to those skilled in the art. For example, the mounting members may mount the resonators in a fixed position with tuning being fixed upon assembly or adjusted through the use of tuning plates and/or conductive members. Such alterations, modifications and improvements as are made obvious by this disclosure are intended to be part of this description though not expressly stated herein, and are intended to be within the spirit and scope of the invention. Accordingly, the foregoing description is by way of example only, and not limiting. The invention is limited only as defined in the following claims and equivalents thereto.

We claim:

1. A dielectric resonator circuit comprising:

a plurality of dielectric resonators, each comprising a body formed of a dielectric material;

a housing enclosing said resonators;

a cross coupling element for permitting electromagnetic coupling between a first one and a second one of said resonators, said cross coupling element having a first end positioned adjacent said first one of said resonators and a second end positioned adjacent said second one of said resonators;

a tuning element for moving said first end of said cross coupling element relative to said first one of said resonators, said tuning element comprising a resilient strip suspended from said housing such that a portion of said strip is unsupported, wherein said first end of said cross coupling element is in contact with said unsupported portion of said strip such that flexing of said resilient strip will cause displacement of said first end of said cross coupling element relative to said first resonator; and a post having a longitudinal axis extending through a hole in said housing such that a proximal end of said post is outside of said housing and a distal end of said post is in contact with said unsupported portion of said strip inside said housing, whereby movement of said post in at least one direction along said longitudinal axis will exert a force on said resilient strip causing it to flex, whereby said first end of said cross coupling element is moved.

2. The circuit of claim 1 wherein said post is a threaded screw and said hole is matingly threaded, whereby rotation of said screw in said hole causes said screw to move along said longitudinal axis.

3. The circuit of claim 2 further comprising a nut threaded onto said screw on an external side of said housing for permitting said screw to be locked in a given position relative to said housing.

4. The circuit of claim 2 wherein said first end of said cross coupling element is affixed to said unsupported portion of said strip.

5. The circuit of claim 2 wherein said resilient strip comprises a hole for accepting said first end of said cross coupling element and said first end of said cross coupling element is positioned within said hole.

6. The circuit of claim 1 wherein said resilient strip comprises a first end, a second end, and a middle portion and wherein said resilient strip is supported on said housing at said first and second ends and is unsupported in said middle portion.

7. The circuit of claim 1 wherein said resilient strip is cantilevered from said housing at said first end.

8. The circuit of claim 7 wherein said first end of said cross coupling element is affixed to said resilient strip at a portion of said resilient strip that is unsupported on said housing and wherein said post contacts said resilient strip.

9. The circuit of claim 1 wherein said cross coupling element is flexible.

10. The circuit of claim 9 wherein said cross coupling element is resilient.

11. The circuit of claim 1 wherein said resilient strip is non-conductive.

12. The circuit of claim 11 wherein said resilient strip is formed of a polymer.

13. The circuit of claim 1 further comprising:

a second post having a second longitudinal axis and extending through a second hole in said housing such that a proximal end of said post is outside of said housing and a distal end of said post is in contact with said second end of said cross coupling element, whereby movement of said second post will exert a force on said second end of said cross coupling element, causing it to move.

14. The circuit of claim 13 wherein said second post includes a radially directed hole in its distal end and said second end of said cross coupling element is inserted in said hole, whereby rotation of said second screw in said second hole causes said second end of said cross coupling element to move.

15. The circuit of claim 14 wherein said second post comprises a threaded screw and said second hole is matingly threaded.

16. The circuit of claim 13 wherein movement of said second post along said second longitudinal axis causes said second end of said cross coupling element to move along said second axis.

17. A dielectric resonator circuit comprising:

a plurality of dielectric resonators, each comprising a body formed of a dielectric material;

a housing enclosing said resonators;

a flexible, conductive cross coupling element for permitting electromagnetic coupling between a first one and a second one of said resonators, said cross coupling element having a first end positioned adjacent said first one of said resonators, a second end positioned adjacent said second one of said resonators and a middle portion, wherein said first and second ends of said cross coupling element are unsupported and said middle portion is supported on said housing;

a post having a proximal end and a distal end defining a longitudinal axis therebetween, said post extending through a hole in said housing such that said proximal end of said post is outside of said housing and said distal end of said post is inside said housing adjacent said first end of said cross coupling element, whereby movement of said post in at least one direction along said longitudinal axis will exert a force on said first end of said cross coupling element causing it to move relative to said first one of said resonators.

18. The circuit of claim 17 wherein said cross coupling element is resilient.

19. The circuit of claim 17 further comprising:

a resilient strip suspended from said housing such that a portion of said strip is unsupported, and wherein said distal end of said post is in contact with said unsupported portion of said strip and said first end of said cross coupling element is in contact with said unsupported portion of said strip such that movement of said post along said longitudinal axis will exert a force on said unsupported portion of said strip causing it to flex thereby causing displacement of said first end of said cross coupling element relative to said first resonator.

20. The circuit of claim 17 wherein said post is a threaded screw and said hole is matingly threaded, whereby rotation of said screw in said hole causes said screw to move along said longitudinal axis.

* * * * *